US011547925B2

(12) United States Patent
Lewison et al.

(10) Patent No.: US 11,547,925 B2
(45) Date of Patent: Jan. 10, 2023

(54) SPIN TIGHTENED SNOWSHOE BINDING

(71) Applicant: Kwik Tek, Inc., Denver, CO (US)

(72) Inventors: Corey A. Lewison, Superior, CO (US); Kevin J. Kresch, Arvada, CO (US)

(73) Assignee: Kwik Tek, Inc., Denver, CO (US)

( * ) Notice: Subject to any disclaimer, the term of this patent is extended or adjusted under 35 U.S.C. 154(b) by 0 days.

(21) Appl. No.: 17/446,342

(22) Filed: Aug. 30, 2021

(65) Prior Publication Data

US 2022/0072408 A1 Mar. 10, 2022

Related U.S. Application Data

(60) Provisional application No. 63/113,354, filed on Nov. 13, 2020, provisional application No. 63/076,065, filed on Sep. 9, 2020.

(51) Int. Cl.
*A63C 13/00* (2006.01)

(52) U.S. Cl.
CPC ..... *A63C 13/001* (2013.01); *A63C 13/006* (2013.01)

(58) Field of Classification Search
CPC ..... A63C 13/00; A63C 13/001; A63C 13/006
(Continued)

(56) References Cited

U.S. PATENT DOCUMENTS 2,511,087 A 6/1950 Villemur
2,699,613 A 1/1955 Peterson
(Continued)

FOREIGN PATENT DOCUMENTS

WO WO03056962 A1 7/2003
WO WO2012 109463A108/16 8/2012
WO WO2019116144 A1 6/2019

OTHER PUBLICATIONS

MSR Evo 22" Snowshoe.
(Continued)

*Primary Examiner* — Marie D Bays
(74) *Attorney, Agent, or Firm* — Talus Law Group LLC

(57) ABSTRACT

A spin-tightened snowshoe binding is provided, the binding comprising a sole plate configured to be hingedly interconnected to a snowshoe an axis extending transversely with respect to the longitudinal axis of the snowshoe, a toe cap interconnected with the sole plate with a first anterior strap and a second anterior strap, wherein the anterior straps are configured to wrap around the medial aspect and the lateral aspects of a toe box of a shoe inserted within the snowshoe binding, and wherein the toe cap is configured to interface with a top aspect of the shoe, a first lateral strap extends outward from the sole plate, wherein the first lateral strap is configured to wrap upward along a medial portion of the shoe, and extend toward a posterior aspect of the shoe, a second lateral strap extends outward from the sole plate, wherein the second lateral strap is configured to wrap upward along a lateral aspect of a shoe, and extend toward the posterior aspect of the snowshoe binding, a belt having a first end and a second end, the belt slideably interconnected with the distal end of the first lateral strap and the distal end of the second lateral strap, wherein the belt is configured to span around the posterior aspect of the shoe between the distal ends of the lateral straps, a tightening dial interconnected with the toe cap, a cable interconnecting the tightening dial, toe cap, sole plate, lateral straps, and first end and second end of the belt, wherein rotating the tightening dial in a first direction tensions the cable, and wherein rotating the tightening dial in a first direction retracts the toe cap toward the sole plate and retracts the first end and second end of the belt toward the toe cap.

20 Claims, 5 Drawing Sheets

(58) Field of Classification Search
USPC ..... 36/122, 125
See application file for complete search history.

(56) References Cited

U.S. PATENT DOCUMENTS

| | | | | |
|---|---|---|---|---|
| 5,459,950 | A | 10/1995 | Damm | |
| 5,469,643 | A * | 11/1995 | Forrest | A63C 13/006 36/122 |
| 5,517,772 | A | 5/1996 | Anderson | |
| 5,740,621 | A | 4/1998 | Wing | |
| 5,970,632 | A | 10/1999 | Watson | |
| 7,509,757 | B2 | 3/2009 | Monsees | |
| 2002/0104235 | A1 | 8/2002 | Mahon | |
| 2003/0052473 | A1 | 3/2003 | Perkins | |
| 2003/0126765 | A1* | 7/2003 | Messmer | A43C 1/00 36/125 |
| 2003/0167657 | A1 | 9/2003 | Kiniry | |
| 2004/0231200 | A1 | 11/2004 | Forrest | |
| 2005/0050773 | A1 | 3/2005 | Kettlehut | |
| 2005/0183291 | A1 | 8/2005 | Kiniry | |
| 2007/0163151 | A1 | 7/2007 | Monsees | |
| 2007/0163152 | A1 | 7/2007 | Emerson | |
| 2007/0163153 | A1* | 7/2007 | Monsees | A63C 13/001 36/122 |
| 2007/0163154 | A1 | 7/2007 | Emerson | |
| 2007/0163155 | A1 | 7/2007 | Emerson | |
| 2010/0126046 | A1* | 5/2010 | Samuels | A63C 13/003 36/122 |
| 2016/0144266 | A1* | 5/2016 | Dussault | A63C 13/006 36/125 |
| 2017/0225061 | A1 | 8/2017 | Locatelli | |
| 2018/0043235 | A1* | 2/2018 | Laug | A63C 13/003 |
| 2020/0298095 | A1* | 9/2020 | Varaine | A63C 13/001 |
| 2022/0071339 | A1* | 3/2022 | Lewison | A63C 13/001 |
| 2022/0072408 | A1* | 3/2022 | Lewison | A63C 13/001 |

OTHER PUBLICATIONS

Yukon Charlie's Elite SPIN Snowshoe.
Atlas Montane Snowshoe.
Atlas Race Snowshoe.
Atlas Range-BC Snowshoe.
Atlas Range-MTN Snowshoe.
Atlas Range-Trail Snowshoe.
Atlas Run Snowshoe.
Yukon Charlie's Running Snowshoe.
Yukon Charlie's Sherpa Series Snowshoe.
Atlas Apex-BC Snowshoe.
MSR Lightning Acent Snowshoe.
MSR Revo Explore Snowshoe.
L.L. Bean Winter Walker Snowshoe.

* cited by examiner

SPIN TIGHTENED SNOWSHOE BINDING

CROSS REFERENCE TO RELATED APPLICATIONS

This application claims the benefit of U.S. Provisional Patent Application 63/076,065, filed on Sep. 9, 2020 and entitled SINGLE PULL SPIN TIGHTENED SNOWSHOE BINDING, and U.S. Provisional Patent Application 63/113,354, filed on Nov. 13, 2020 and entitled SPIN TIGHTENED SINGLE-PULL RELEASE SNOWSHOE BINDING, the entire contents of both of which are incorporated herein by reference in their entirety for all purposes.

FIELD OF THE INVENTION

The present invention is directed to a spin tightened snowshoe binding for releasably interconnecting to a shoe through a single action rather than requiring multiple steps to transition between a first configuration allowing the insertion of a shoe into the binding and second configuration constraining the shoe within the binding.

SUMMARY OF INVENTION

A spin-tightened, single-pull release snowshoe binding is provided, the binding comprising a sole plate configured to be hingedly interconnected to a snowshoe along an axis extending transversely with respect to the longitudinal axis of the snowshoe, a toe cap interconnected with the sole plate with a first anterior strap and a second anterior strap, wherein the anterior straps are configured to wrap around the lateral aspects of a toe box of a shoe inserted within the snowshoe binding, and wherein the toe cap is configured to interface with a top aspect of the shoe, a first lateral strap extends outward from the sole plate, wherein the first lateral strap is configured to wrap upward along a lateral aspect of the shoe, and extend toward a posterior aspect of the shoe, a second lateral strap extends outward from the sole plate, wherein the second lateral strap is configured to wrap upward along a lateral aspect of a shoe, and extend toward the posterior aspect of the snowshoe binding, a belt having a first end and a second end, the belt slideably interconnected with the distal end of the first lateral strap and the distal end of the second lateral strap, wherein the belt is configured to span around the posterior aspect of the shoe between the distal ends of the lateral straps, a tightening dial interconnected with the toe cap, a cable interconnecting the tightening dial, toe cap, sole plate, lateral straps, and first end and second end of the belt, wherein rotating the tightening dial in a first direction tensions the cable, and wherein rotating the tightening dial in a first direction retracts the toe cap toward the sole plate and retracts the first end and second end of the belt toward the toe cap. The present invention provides a number of advantages depending on the particular aspect, embodiment, and/or configuration.

The preceding is a simplified summary of the disclosure to provide an understanding of some aspects of the disclosure. This summary is neither an extensive nor exhaustive overview of the disclosure and its various aspects, embodiments, and/or configurations. It is intended neither to identify key or critical elements of the disclosure nor to delineate the scope of the disclosure but to present selected concepts of the disclosure in a simplified form as an introduction to the more detailed description presented below. As will be appreciated, other aspects, embodiments, and/or configurations of the disclosure are possible utilizing, alone or in combination, one or more of the features set forth above or described in detail below. Also, while the disclosure is presented in terms of exemplary embodiments, it should be appreciated that individual aspects of the disclosure can be separately claimed.

DETAILED DESCRIPTION OF VARIOUS EMBODIMENTS

Figure 1:
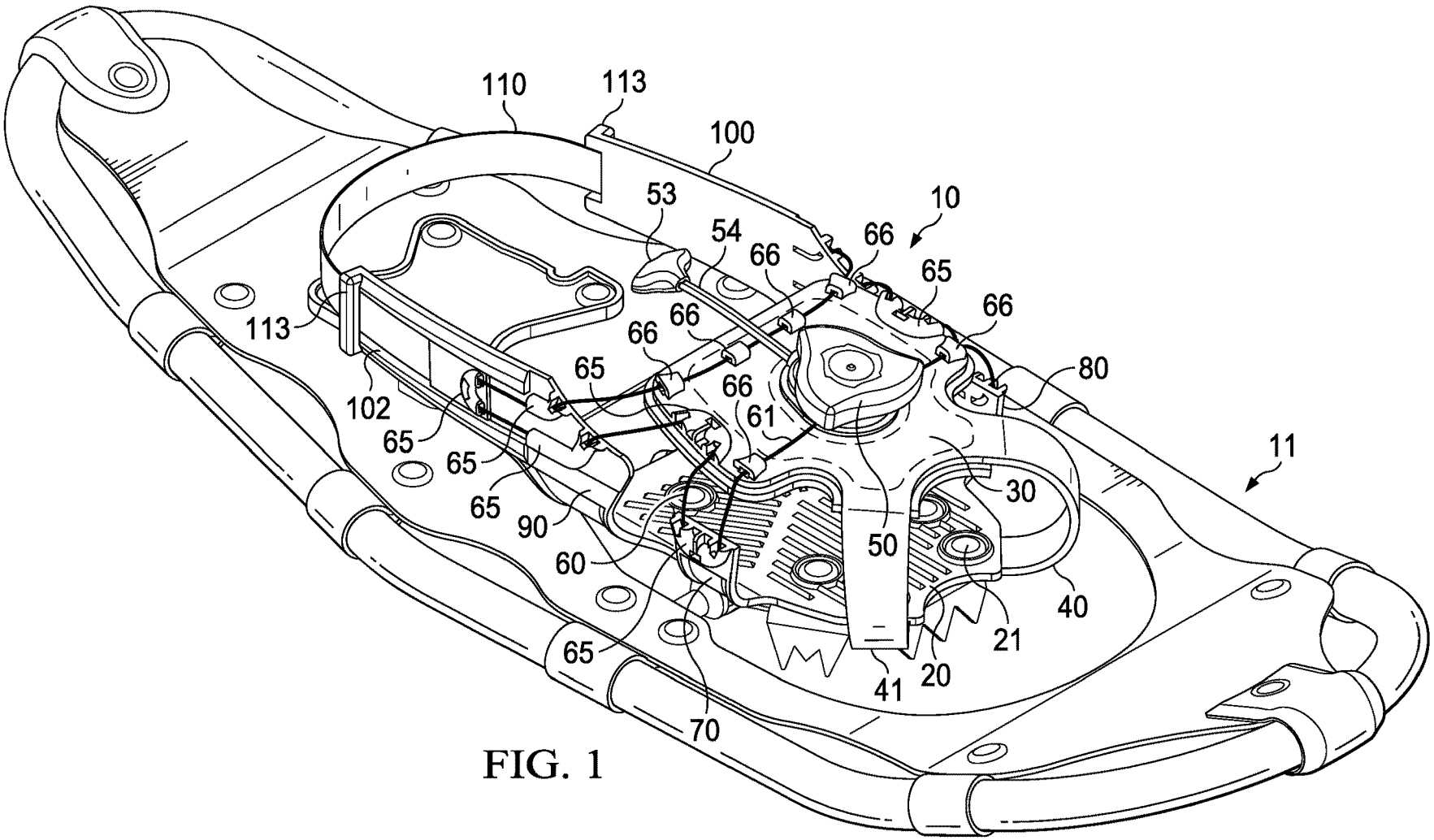
FIG. 1 is a top perspective view of a spin tightened snowshoe binding according to one embodiment of the present disclosure.

Referring to an exemplary embodiment of the present invention, shown in FIGS. 1-5, is a snowshoe binding 10 generally comprising a sole plate 20, a toe cap 30, first anterior strap 40 and second anterior strap 41, a tightening dial mechanism 50, a cable 60, a first lateral strap 70, a second lateral strap 80, a third lateral strap 90, a fourth lateral strap 100, and a belt 110.

Figure 2:
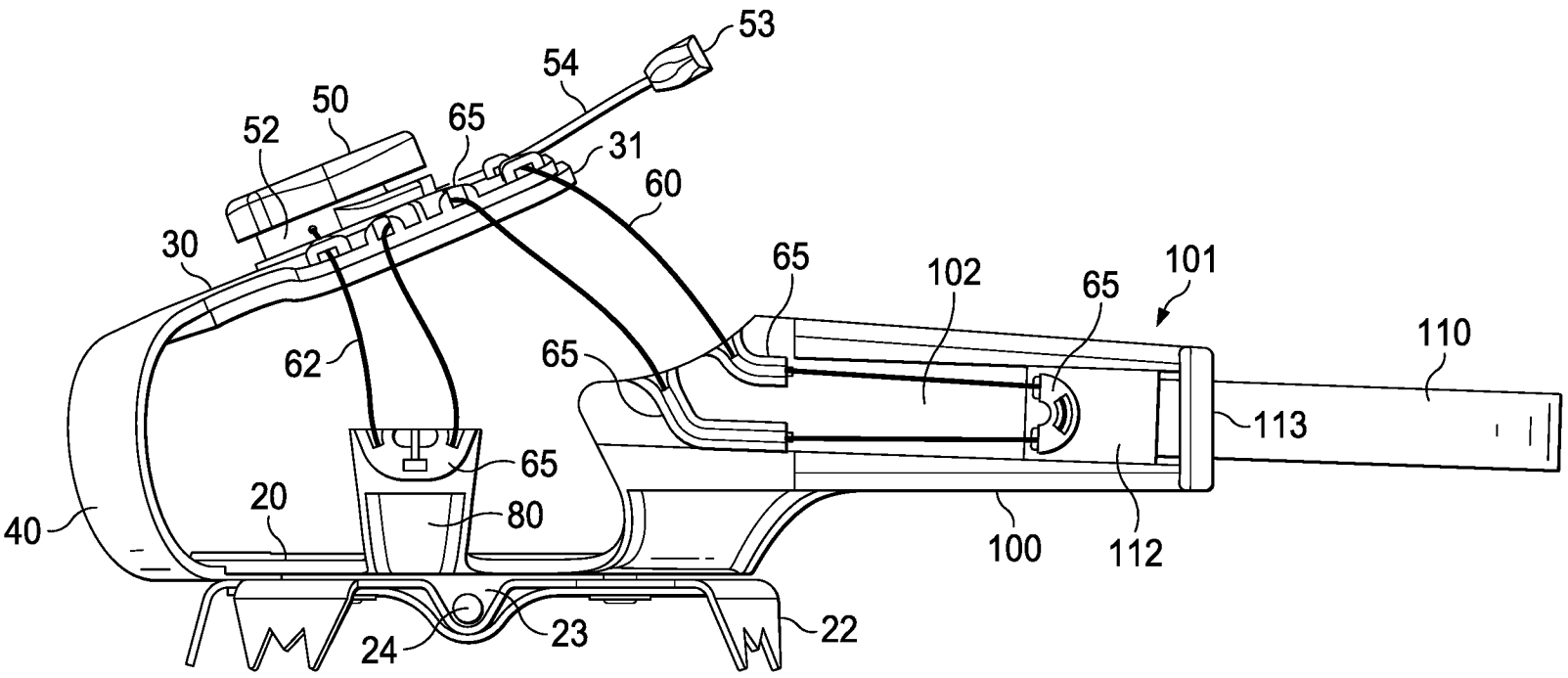
FIG. 2 is a left elevation view of a spin tightened snowshoe binding in a first configuration according to one embodiment of the present disclosure.
Figure 3:
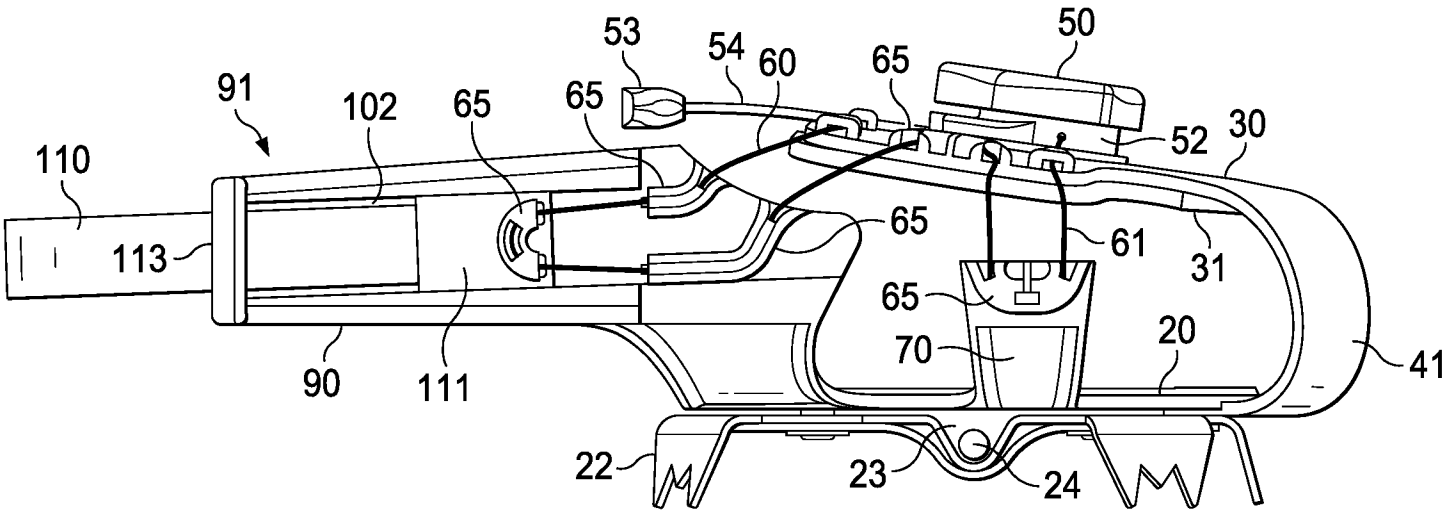
FIG. 3 is a right elevation view of a spin tightened snowshoe binding in a second configuration according to one embodiment of the present disclosure.
Figure 5:
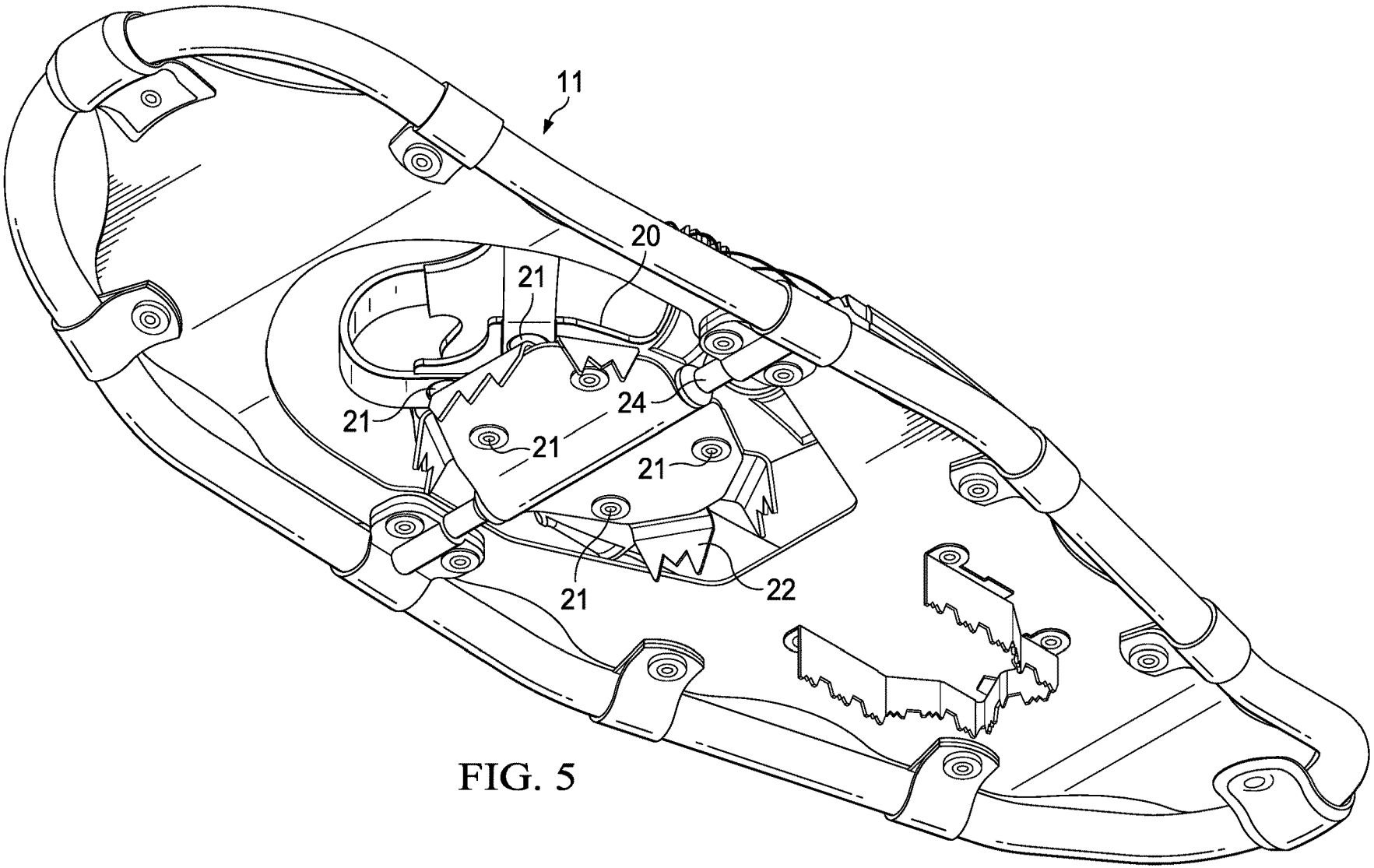
FIG. 5 is a bottom perspective view of a spin tightened snowshoe binding according to one embodiment of the present disclosure.

As shown in FIGS. 2-3 and 5, the sole plate 20 is hingedly interconnected to a snowshoe 11 along an axis extending transversely to the longitudinal axis of the snowshoe 11. In a preferred embodiment, the sole plate 20 is interconnected by rivets 21 or bolts to a crampon plate 22 comprising an axial channel 23. An axle 24 affixed to the snowshoe 11 is rotatably contained within the axial channel 23 between the sole plate 20 and the crampon plate 22 so that the sole plate 20 may hinge about the axle 24. In a preferred embodiment, the sole plate 20 is made of molded polyurethane and the crampon plate 22 is made of steel or aluminum.

As shown in FIG. 1, in a preferred embodiment, first anterior strap 40 and second anterior strap 41 are interconnected to the toe cap 30 and configured to wrap around the front lateral aspects of the toe box of a shoe. In one embodiment, the straps 40 and 41 are interconnected to the sole plate 20 by rivets 21. However, the anterior straps 40 and 41 could be integrally formed with the sole plate 20. Likewise, in the embodiment shown, the anterior straps 40 and 41 are integrally formed with the toe cap 30. However, the anterior straps 40 and 41 could be interconnected to the toe cap 30 by other methods such as by riveting. In another embodiment, the toe cap 30 is interconnected to the sole plate by a single anterior strap or by more than two anterior straps. Alternatively, the toe cap 30 is shaped to receive the toe portion of a shoe and is interconnected to the sole plate 20 or formed with the sole plate 20 from a single piece of flexible material. The toe cap 30 is configured to receive the toe portion of a shoe wherein the sole plate 20 supports the bottom aspect of the shoe, the toe cap 30 rests on the top aspect of the shoe, and the anterior straps 40 and 41 interface with the front lateral aspects of the toe portion of the shoe. Alternatively, the toe cap 30 is shaped to receive the toe portion of the shoe and interfaces with the top and front aspects of the shoe. In a preferred embodiment, the toe cap 30 and anterior straps 40 and 41 are made of molded polyurethane. In some embodiments, the toe cap 30 may further comprise a pad 31 on the bottom surface made of EVA foam in a preferred mode.

As shown in FIG. 2, in a first configuration, the toe cap 30 is extended away from the sole plate 20 allowing the insertion of the toe portion of a shoe between the sole plate 20, the toe cap 30 and in contact with the anterior straps 40 and 41. As shown in FIG. 3, in a second configuration, the toe cap 30 is retracted toward the sole plate 20 thereby interconnecting the shoe between the sole plate 20 and the toe cap 30.

As shown in FIG. 1-3, in a preferred embodiment, tightening dial mechanism 50 is interconnected to the top surface of the toe cap 30, the tightening dial mechanism 50 comprises a dial 51 that is rotatably interconnected to a spool within the tightening dial housing 52. Cable 60 has a first end 61 and a second end 62 which are each interconnected to the spool. Tightening of the cable 60 is achieved when the dial 51 is turned to rotate the spool. Rotation of the tightening dial 51 in a first direction spools both ends 61 and 62 of the cable onto the spool within the tightening dial housing 52, thereby shortening the cable 60 at a 2:1 ratio. Alternatively, in another embodiment, a first end of the cable 61 is interconnected to the spool and the second end 62 is anchored to an alternative location such as to the tightening dial housing 52 or to the toe cap 30. The rotation of the tightening dial 51 in a first direction spools the first end 61 of the cable 60 into the tightening dial housing 52, thereby shortening the cable at a 1:1 ratio. The connections of the first end 61 and second end 62 of the cable 60 may also be reversed in the previous example. In a preferred embodiment, the cable 60 is comprised of ultra-high molecular weight polyethylene.

In one embodiment, the tightening dial mechanism 50 further comprises a spool release. The spool release may be a ratchet and pawl which prevents the spool from rotating in a reverse direction from the first direction. The pawl is interconnected to a T-bar toggle 53 with a string or cord 54, wherein pulling on the T-bar toggle 53 releases the pawl from the ratchet and allows the spool to rotate in a reverse from the first direction, allowing the cable 60 to unspool. Beginning in the first configuration, rotation of the tightening dial 51 in a first direction spools the cable 60 into the tightening dial housing 52, thereby shortening the cable 60 and retracting the toe cap 30 towards the sole plate 20, thereby placing the snowshoe binding in the second configuration. Beginning in the second configuration, pulling the T-bar toggle 53 releases the cable 60, allowing the toe cap 30 to extend away from the sole plate 20, thereby placing the snowshoe binding in the first configuration. In an alternative embodiment, the tightening dial mechanism 50 comprises a device that permits the spool to be rotated in a first direction and second direction while maintaining sufficient rotational resistance on the spool such that the cable will not loosen under ordinary tension during use of the binding. Such devices may include a clutch, ball and detent, ratchet and pawl, friction components, or rack and pinion.

As shown in FIGS. 1-4, in a preferred embodiment comprising flexible lateral straps 70, 80, 90 and 100, the lateral straps are interconnected with the sole plate 20. The first lateral strap 70 extends outward from the sole plate and is configured to wrap upward along a lateral aspect of the shoe. The second lateral strap 80 extends outward from the sole plate and is configured to wrap upward along a lateral aspect of the shoe. The distal ends of the first and second lateral straps 70 and 80 comprise slidable routing guides 65. The third lateral strap 90 extends outward from the sole plate and is configured to wrap upward along a lateral aspect of the shoe, then extend toward a posterior aspect of a shoe. The fourth lateral strap 100 extends outward from the sole plate and is configured to wrap upward along a lateral aspect of a shoe, then extend toward the posterior aspect of the shoe. The anterior portions of the third and fourth lateral straps 90 and 100 comprise routing guides 65. In a preferred embodiment, the lateral straps 70, 80, 90 and 100 are comprised of a flexible but resilient material, such as molded polyurethane, which allow the lateral straps 70, 80, 90 and 100 to conform around a shoe when the snowshoe binding 10 is tightened, but that tend to spring back towards an open position when the snowshoe binding 10 is loosened. In another alternative embodiment, the first and second lateral straps 70 and 80 are omitted.

Figure 4:
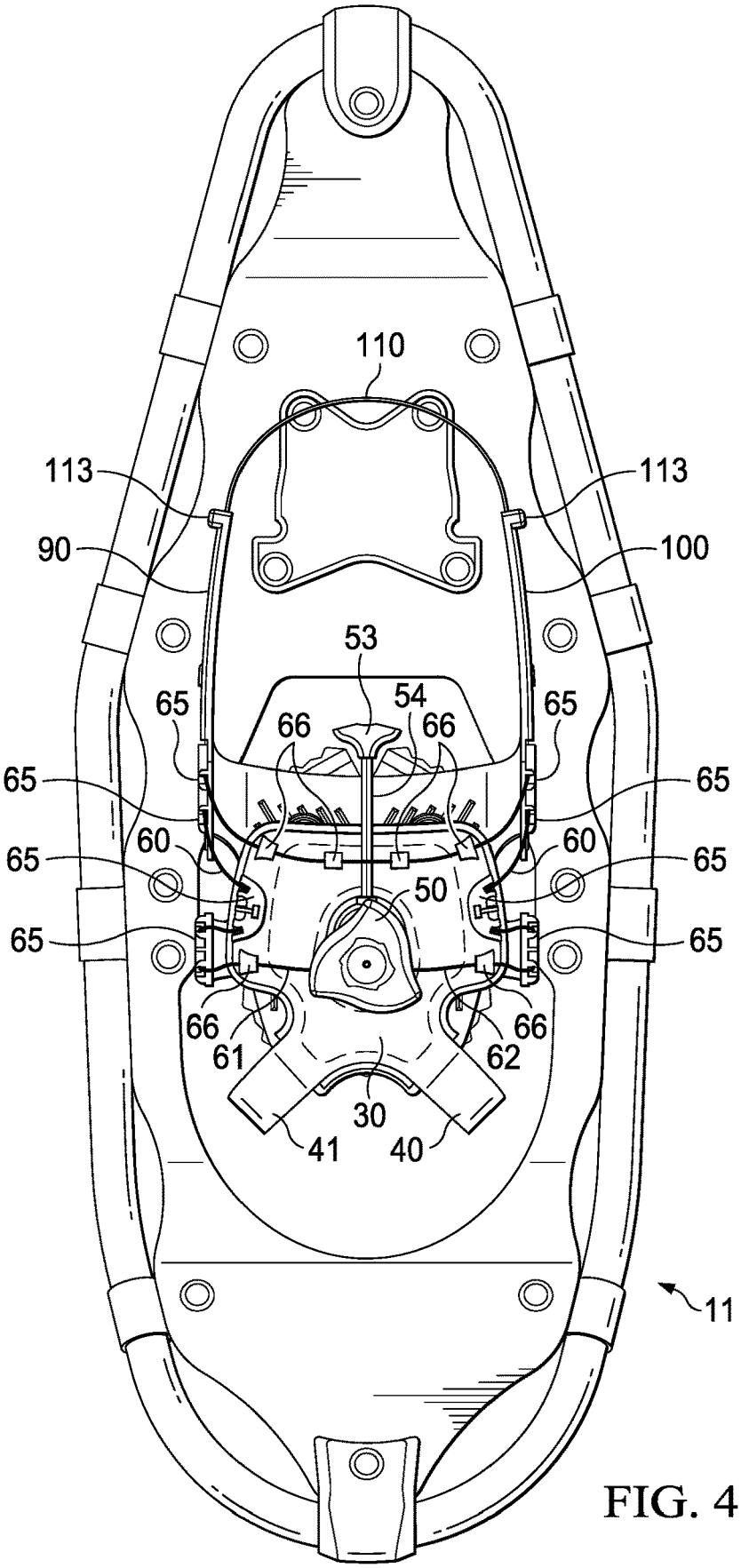
FIG. 4 is a top view of a spin tightened snowshoe binding according to one embodiment of the present disclosure.

As shown in FIGS. 2-4, the distal ends 91 and 101 of the third and fourth lateral straps 90 and 100 at the posterior aspect of the shoe are slideably interconnected with belt 110. The belt has a first end 111 and a second end 112, and is configured to span around the posterior aspect of the shoe between the distal ends 91 and 101 of the lateral straps. Each distal end 91 and 101 comprises a channel 102 in which the belt ends 91 and 101 slides to maintain the longitudinal orientation of the belt 110 relative to the extended direction of the posterior portions of the third and fourth lateral straps 90 and 100. Sleeves 113 at the distal ends of the third and fourth lateral straps 90 and 100 retain the belt ends 91 and 101. The first and second ends of the belt 91 and 101 further comprise slidable routing guides 65 though which cable 60 passes. In a preferred embodiment, the belt is comprised of a nylon webbing with a thermoplastic polyurethane coating.

As shown in FIGS. 1-3, in a preferred embodiment, the routing guides 65 of the present invention are comprised of a low-friction passageway or channel shaped and sized to contain the cable and with a first end and a second openings that orient the direction of travel of the cable. The "U" shape routing guides 65 shown in FIGS. 1-3 orient the direction of cable travel to an about 180 degree path and permits the cable to slidably enter and exit the guide openings in directions that are relatively parallel. The "J" shape routing guides 65 shown in FIGS. 2-3 orient the direction of cable travel to an about 45 to 90 degree path and permits the cable to slidably enter and exit the guide openings in directions that are relatively obtuse. Other orientations of cable travel from 1 to 179 degrees can be accomplished by adjusting the shape of the routing guides 65. As shown in FIGS. 1 and 4, in a preferred embodiment, slidable guides 66 hold the cable 60 in a preferred position to prevent lateral movement. The routing guides 65, when guiding the cable around a turn, maintain a minimum turn radius to avoid binding and kinking of the cable. The radius of curvature of the passageway or channel in the routing guides is sufficiently large as to prevent permanent deformation of the cable from bending. In a preferred embodiment, the radius is about 0.25 to 0.50 inches. In another embodiment, the radius is about 0.125 to 0.75 inches. In another embodiment, the radius is about 0.375 to 1 inches. In a preferred embodiment, the guides 65 and 66 are molded into the toe cap, lateral straps, and belt ends. In alternative embodiments, a D-ring, eyelet, roller, hook, or post could be used in the place of guides 65 and 66. The guides 65 and 66 of the toe cap 30, first lateral strap 70, and second lateral strap 80 are preferably located to route the cable 60 along a posterior aspect of the toe cap 30 to tension evenly over the tarsals and metatarsals of a user's foot, thereby avoiding cutting off circulation to the user's toes.

The cable 60 is interconnected between the toe cap 30, the sole plate 20, the lateral straps 70, 80, 90 and 100, and the first and second ends of the belt 111 and 112. As shown in FIGS. 1-3, the cable travels from the first end 61 sequentially through: (1) a slidable guide 66 on the top surface of the toe cap 30; (2) a routing guide 65 on the first lateral strap 70; (3) a routing guide 65 on the toe cap 30; (4) a first routing guide 65 on the third lateral strap 90; (5) a routing guide 65 on the first end 111 of the belt 110; (6) a second routing guide 65 on the third lateral strap 90; (7) a series of slidable guides 66 along the top posterior surface of the toe cap 30; (8) a first routing guide 65 on the fourth lateral strap 100; (9) a routing guide 65 on the second end 112 of the belt 110; (10) a second routing guide 65 on the fourth lateral strap 100; (11) a routing guide 65 on the toe cap 30; (12) a routing guide 65 on the second lateral strap 80; and (13) a slidable guide 66 on the top surface of the toe cap 30 to the second end 62. Tensioning of the cable 60 using the tightening dial mechanism 50 retracts both lateral sides of the toe cap 30 downward simultaneously and relatively equally and uniformly toward the sole plate 20 and retracts both ends 111 and 112 of the belt 110 simultaneously and relatively equally and uniformly in an anterior direction of the snowshoe binding.

As shown in FIG. 2, in a first configuration, the toe cap 30 is extended away from the sole plate 20 and the belt 110 is extended in a posterior direction of the snowshoe binding. The first configuration allows the insertion of the toe box of a shoe between the sole plate 20, the toe cap 30, and in contact with the anterior straps 40 and 41, and the heel of the shoe between the lateral straps 90 and 100 and forward of the belt 110. As shown in FIG. 3, in a second configuration, rotation of the dial 51 causes the cable 60 to tighten and retract the toe cap 30 toward the sole plate 20 thereby interconnecting the shoe between the sole plate 20 and the toe cap 30, and the first and second belt ends 111 and 112 to retract forward, thereby tensioning the lateral straps 70, 80, 90 and 100 and belt 110 around the posterior aspect of the shoe and urging the shoe in a forward direction towards the first and second anterior straps 40 and 41.

In another alternative embodiment, the belt 110 is interconnected to one of the third or fourth lateral straps 90 or 100 and is slideably interconnected to the other third or fourth lateral straps 90 or 100. The cable 60 is interconnected to the belt end that is adjacent to the slidable connection with the lateral strap. Rotation of the dial 51 causes the cable 60 to tighten and retract the toe cap 30 toward the sole plate 20 thereby interconnecting the shoe between the sole plate 20 and the toe cap 30, and the single belt end to retract forward, thereby tensioning the lateral straps 70, 80, 90 and 100 and belt 110 around the posterior aspect of the shoe and urging the shoe in a forward direction towards the first and second anterior straps 40 and 41.

As used herein, the phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" means A alone, B alone, C alone, A and B together, A and C together, B and C together, or A, B and C together. The term "a" or "an" entity refers to one or more of that entity. As such, the terms "a" (or "an"), "one or more" and "at least one" can be used interchangeably herein. It is also to be noted that the terms "comprising," "including," and "having" are used interchangeably and are meant to encompass the items listed thereafter and equivalents thereof, as well as additional items. As used herein, the term "lateral" means of, at, toward, or from the side or sides. The term "medial" is often used to medically refer to the inside of the foot and "lateral" is used to medically refer to the outside of the foot, but herein, "lateral" can refer to either the inside or outside of a foot or shoe.

The structural materials employed advantageously in the present invention are fashioned from: molded, injected, extruded, or machined plastics; molded, injected, extruded, or machined rubber; extruded, machined, or cast aluminum, stainless steel, or other metals; and suitable alternatives are available, as one skilled in the art would recognize readily. Likewise, any padding, where padding is desirable, is preferably some kind of foamed elastomer, though other suitable materials exist. Other hardware, brackets, locking pins and supports may be fashioned from aluminum, stainless steel, brass, or other suitable material. One of ordinary skill in the art will appreciate that embodiments of the present disclosure may be constructed of materials known to provide, or predictably manufactured to provide the various aspects of the present disclosure. These materials may include, for example, stainless steel, titanium alloy, aluminum alloy, chromium alloy, and other metals or metal alloys. These materials may also include, for example, carbon fiber, ABS plastic, polyurethane, and other fiber-encased resinous materials, synthetic materials, polymers, and natural materials. The system and its elements could be flexible, semi-rigid, or rigid and made of materials such as stainless steel, titanium alloy, aluminum alloy, chromium alloy, and other metals or metal alloys, carbon fiber, ABS plastic, polyurethane, and other fiber-encased resinous materials, synthetic materials, polymers, and natural materials. In one embodiment, some or all components are manufactured by way of 3-D printing.

The present disclosure, in various aspects, embodiments, and/or configurations, includes components, methods, processes, systems and/or apparatus substantially as depicted and described herein, including various aspects, embodiments, configurations embodiments, sub-combinations, and/or subsets thereof. Those of skill in the art will understand how to make and use the disclosed aspects, embodiments, and/or configurations after understanding the present disclosure. The present disclosure, in various aspects, embodiments, and/or configurations, includes providing devices and processes in the absence of items not depicted and/or described herein or in various aspects, embodiments, and/or configurations hereof, including in the absence of such items as may have been used in previous devices or processes, e.g., for improving performance, achieving ease and/or reducing cost of implementation.

The foregoing description has been presented for purposes of illustration and description. The foregoing is not intended to limit the disclosure to the form or forms disclosed herein. In the foregoing description for example, various features of the disclosure are grouped together in one or more aspects, embodiments, and/or configurations for the purpose of streamlining the disclosure. The features of the aspects, embodiments, and/or configurations of the disclosure may be combined in alternate aspects, embodiments, and/or configurations other than those discussed above. This method of disclosure is not to be interpreted as reflecting an intention that the claims require more features than are expressly recited in each claim. Rather, as the following claims reflect, inventive aspects lie in less than all features of a single foregoing disclosed aspect, embodiment, and/or configuration. References to a shoe in the claims herein is intended to express the functionality of the binding relative to a shoe that may be inserted within the binding and is not intended to require that a shoe be within the binding in the claimed invention.

While various embodiments of the present invention are described herein in detail, it is apparent that modifications and alterations of those embodiments will occur to those skilled in the art. However, it is to be expressly understood that such modifications and alterations are within the scope and spirit of the present invention. Further, the inventions described herein are capable of other embodiments and of being practiced or of being carried out in various ways. In addition, it is to be understood that the phraseology and terminology used herein is for the purposes of description and should not be regarded as limiting. Moreover, though the description has included description of one or more aspects, embodiments, and/or configurations and certain variations and modifications, other variations, combinations, and modifications are within the scope of the disclosure, e.g., as may be within the skill and knowledge of those in the art, after understanding the present disclosure. It is intended to obtain rights which include alternative aspects, embodiments, and/or configurations to the extent permitted, including alternate, interchangeable and/or equivalent structures, functions, ranges, or steps to those claimed, whether or not such alternate, interchangeable and/or equivalent structures, functions, ranges or steps are disclosed herein, and without intending to publicly dedicate any patentable subject matter.

What is claimed is:

1. A snowshoe binding comprising:

a sole plate configured to be hingedly interconnected to a snowshoe along an axis extending transversely to a longitudinal axis of the snowshoe;

a toe cap interconnected to the sole plate, wherein the toe cap is configured to interface with a top aspect of a shoe inserted within the snowshoe binding;

a first lateral strap extending outward from the sole plate, wherein the first lateral strap is configured to wrap upward along a lateral aspect of the shoe and extend toward a posterior aspect of the shoe;

a second lateral strap extending outward from the sole plate, wherein the second lateral strap is configured to wrap upward along a lateral aspect of a shoe and extend toward the posterior aspect of the shoe;

a belt having a first end and a second end, the first end slideably interconnected with a distal end of the first lateral strap and the second end interconnected with a distal end of the second lateral strap, wherein the belt is configured to span around the posterior aspect of the shoe between the distal ends of the lateral straps;

a tightening dial mechanism interconnected to a top surface of the toe cap;

a cable having a first end and a second end, the cable interconnecting the tightening dial mechanism, toe cap, first lateral strap, second lateral strap, and first end and second end of the belt;

wherein rotation of the tightening dial in a first direction shortens the cable; and wherein shortening of the cable retracts the toe cap toward the sole plate and retracts the first end of the belt toward an anterior aspect of the shoe.

2. The snowshoe binding of claim 1 further comprising a first anterior strap interconnected to the sole plate and toe cap, wherein the first anterior strap is configured to wrap around the lateral aspects of a toe box of a shoe inserted within the snowshoe binding.

3. The snowshoe binding of claim 2 further comprising a second anterior strap interconnected to the sole plate and toe cap, wherein the second anterior strap is configured to wrap around the lateral aspects of the toe box.

4. The snowshoe binding of claim 1 further comprising a third lateral strap extending outward from the sole plate and configured to wrap upward along a lateral aspect of the shoe.

5. The snowshoe binding of claim 4 further comprising a fourth lateral strap extending outward from the sole plate and configured to wrap upward along a lateral aspect of the shoe.

6. The snowshoe binding of claim 5 wherein the cable interconnects the third and fourth lateral straps with the tightening dial mechanism, toe cap, first lateral strap, second lateral strap, and first end and second end of the belt.

7. The snowshoe binding of claim 1 wherein the tightening dial mechanism comprises a dial that is rotatably interconnected to a spool within a housing.

8. The snowshoe binding of claim 7 wherein the first end of the cable is interconnected to the spool.

9. The snowshoe binding of claim 8 wherein the second end of the cable is interconnected to the spool.

10. The snowshoe binding of claim 7 wherein the second end of the cable is interconnected to the housing or the toe cap.

11. The snowshoe binding of claim 7 wherein the tightening dial mechanism further comprises a spool release.

12. The snowshoe binding of claim 1 wherein the cable is slidably interconnected to the first end of the belt by a routing guide.

13. The snowshoe binding of claim 12 wherein the second end of the belt is slideably interconnected with the distal end of the second lateral strap, wherein the cable is slidably interconnected to the second end of the belt by a routing guide, and wherein shortening of the cable retracts the second end of the belt toward an anterior aspect of the shoe.

14. The snowshoe binding of claim 13 wherein shortening of the cable retracts both ends of the belt simultaneously and about equally in the anterior direction.

15. The snowshoe binding of claim 13 wherein shortening of the cable retracts a first and a second lateral side of the toe cap simultaneously and about equally in a downward direction toward the sole plate.

16. The snowshoe binding of claim 6 wherein the cable is slidably interconnected to the third lateral strap by a routing guide and slidably interconnected to the fourth lateral strap by a routing guide.

17. The snowshoe binding of claim 1 wherein the toe cap further comprises a plurality of slidable cable guides through which the cable passes.

18. The snowshoe binding of claim 1 wherein rotation of the tightening dial in a second direction lengthens the cable.

19. The snowshoe binding of claim 13 wherein lengthening of the cable allows extension of the first and second ends of the belt in a posterior direction.

20. A snowshoe binding comprising:

a sole plate configured to be hingedly interconnected to a snowshoe along an axis extending transversely to a longitudinal axis of the snowshoe;

a toe cap configured to interface with a top aspect of a shoe inserted within the snowshoe binding, the toe cap comprising a first lateral cable routing guide, a second lateral cable routing guide, and a slidable cable guide;

a first anterior strap interconnected to the sole plate and toe cap and a second anterior strap interconnected to the sole plate and toe cap, wherein the first and second anterior straps are configured to wrap around the lateral aspects of a toe box of a shoe inserted within the snowshoe binding;

a first lateral strap extending from the sole plate, wherein the first lateral strap is configured to wrap upward along a lateral aspect of the shoe and extend toward a posterior aspect of the shoe, the first lateral strap comprising a channel in a distal end thereof;

a second lateral strap extending from the sole plate, wherein the second lateral strap is configured to wrap upward along a lateral aspect of a shoe and extend toward the posterior aspect of the shoe, the second lateral strap comprising a channel in a distal end thereof;

a third lateral strap extending outward from the sole plate and configured to wrap upward along a lateral aspect of the shoe, the third lateral strap comprising a routing guide at a distal end;

a fourth lateral strap extending outward from the sole plate and configured to wrap upward along a lateral aspect of the shoe, the fourth lateral strap comprising a routing guide at a distal end;

a belt having a first end and a second end, wherein the belt is configured to span around the posterior aspect of the shoe between the distal ends of the lateral straps;

the first end of the belt comprising a cable routing guide, the first end of the belt slideably interconnected with the channel of the first lateral strap;

the second end of the belt comprising a cable routing guide, the second end of the belt slideably interconnected with the channel of the second lateral strap;

a tightening mechanism interconnected to a top surface of the toe cap comprising a spool rotatably interconnected to a tightening dial;

a cable having a first end and a second end, the first and second ends of the cable interconnected to the spool;

wherein the cable is slidably interconnected to the first lateral cable routing guide of the toe cap, the second lateral cable routing guide of the toe cap, the slidable cable guide of the toe cap, the cable routing guide of the first end of the belt, the cable routing guide of the second end of the belt, the cable routing guide of the third lateral strap, and the cable routing guide of the fourth lateral strap;

wherein rotation of the spool in a first direction shortens the cable; and wherein shortening of the cable retracts the toe cap toward the sole plate and retracts the first end and second end of the belt toward an anterior aspect of the shoe.

* * * * *